United States Patent [19]

Austin

[11] 4,283,854

[45] Aug. 18, 1981

[54] HUNTER'S KNIFE

[76] Inventor: Marvin L. Austin, Rte. 1, Box 117, Mount Pleasant, N.C. 28124

[21] Appl. No.: 142,730

[22] Filed: Apr. 22, 1980

[51] Int. Cl.[3] ..... B26B 3/00

[52] U.S. Cl. ..... 30/314; 30/298; 30/317; 30/340

[58] Field of Search ..... 30/317, 314, 298, 291, 30/340

[56] References Cited

U.S. PATENT DOCUMENTS

| | | | |
|---|---|---|---|
| 123,497 | 2/1872 | McCarraher | 30/317 |
| 164,880 | 6/1875 | Shelton | 30/314 |
| 680,030 | 8/1901 | Emans | 30/298 |
| 912,146 | 2/1909 | Moffett | 30/314 |
| 1,023,741 | 4/1912 | Kreith | 30/340 |
| 1,398,850 | 11/1921 | Franco | 30/314 |
| 1,546,975 | 7/1925 | Feller | 30/317 |
| 2,359,098 | 9/1944 | Engle | 30/340 |
| 2,517,840 | 8/1950 | Chatlos | 30/314 |
| 3,865,370 | 2/1975 | Rogers | 30/340 |
| 4,087,911 | 5/1978 | Schrock et al. | 30/298 |

FOREIGN PATENT DOCUMENTS

| | | | |
|---|---|---|---|
| 148888 | 2/1955 | Sweden | 30/317 |

*Primary Examiner*—Stephen G. Kunin
*Assistant Examiner*—J. T. Zatarga
*Attorney, Agent, or Firm*—Bell, Seltzer, Park & Gibson

[57] ABSTRACT

A hunter's knife is provided which is adapted for both eviscerating and skinning a game animal in the field. The knife has a blade portion which includes a reversely facing hook-shaped portion formed on one side, with the hook-shaped portion having a sharpened arcuate inner edge and a relatively blunt outer end. The other side of the blade has a continuous cutting edge formed along substantially its full length. The handle of the knife includes a generally T-shaped finger engaging member for securing the knife to the user's hand while the palm is either closed about the handle, or open, to thereby permit the knife to be retained on the hand while the hand is used for a non-cutting purpose, such as manipulating the animal carcass. The blade and handle are preferably integrally formed from a metallic material, such as stainless steel.

12 Claims, 11 Drawing Figures

HUNTER'S KNIFE

The present invention relates to a knife particularly adapted for use by hunters in eviscerating and skinning animals in the field.

It is well understood that game animals killed in the field must be quickly eviscerated or gutted in order to avoid spoilage of the meat. In this regard, an incision is usually made through the skin or hide of the animal, and which extends from a point near the crotch to the rib cage. A conventional hunting knife is most often used for this purpose, but its use requires considerable skill to avoid injury to the user as well as to make a proper incision. In particular, the user must be careful to avoid puncturing of the entrails by the point or blade of the knife, which could result in the contents of the entrails being released and tainting the meat. Also, a conventional hunting knife is not well suited for severing heavy cartilage or the light bone structure which may be encountered along the incision.

Further difficulty in making a proper and clean incision arises from the fact that the carcass must be periodically moved or manipulated in order to permit access along the full length of the incision, particularly when the animal is lying on the ground. This movement usually requires that the knife be laid down on the ground to free the hand several times during the cutting operation, and as a result, the knife can pick up dirt and debris from the ground which subsequently enters the carcass when cutting is resumed.

The free use of both hands is also required at periodic times during the skinning of the animal, to draw or pull the hide from the body. Thus the knife must be repeatedly laid down and picked up during the skinning operation, which is not only tedious, but also can contaminate the knife, and thus the meat, with debris.

Several specially designed knives have been proposed for facilitating the evisceration or gutting of game animals. For example, U.S. patent to Addis, U.S. Pat. No. 3,839,788 discloses a special purpose knife having a hook-shaped blade portion which is adapted to be drawn through the hide, and a separate exterior blade for skinning the animal. While this knife has been commercialized, it is not totally satisfactory since the blades appear to be exposed so as to unduly risk injury to the user. Also, the handle includes two finger holes for receiving fingers therethrough to provide for a secure grip of the knife, but such holes render it difficult to repeatedly remove and then replace the knife on the hand, which is necessary particularly during the skinning operation. In this regard, the finger holes prevent the fingers of the hand from being laterally spread apart, which is highly desirable in order to properly grip the hide when it is periodically drawn from the body during skinning. Thus it is not feasible to maintain the Addis knife on the hand during skinning, and the knife must be repeatedly removed and then replaced on the hand. This repeated removal and replacement is further complicated by the fact that the fingers extend through openings, and both hands are normally required to effect such removal and replacement.

It is accordingly an object of the present invention to provide a knife adapted for both eviscerating and skinning animals in the field, and which avoids the above noted deficiencies of the prior knives.

It is also an object of the present invention to provide a knife of the described type which is adapted to be retained on the user's hand when the palm thereof is either closed about the handle, or open, to thereby permit the knife to be retained on the hand while the knife is used to manipulate the animal carcass or the like, and thereby avoid the need for periodically placing the knife on the ground.

It is a more specific object of the present invention to provide a knife of the described type which includes a finger engaging member which acts to secure the knife to the user's hand when the palm is open, and which further is able to accommodate the lateral spreading of the fingers without releasing the knife, to thereby permit the free use of the fingers while the knife is retained on the hand.

It is another object of the present invention to provide a knife of the described type which may be readily placed in position on the hand, and using only the hand which is to hold the knife. Further objects include providing a knife which is safe in use, and which can be readily drawn through the hide without puncturing the entrails.

It is a further object of the present invention to provide a knife of the described type which includes a relatively straight, sharp edge portion which is adapted for chopping through various parts of the animal carcass, such as cartilage or light bone.

These are other objects and advantages of the present invention are achieved in the embodiment illustrated herein by the provision of a knife which comprises an elongate body defining a blade portion and a handle portion. The blade portion is formed of a metallic material and includes opposite sides, with one side having a hook-shaped portion formed therein, and with the hook-shaped portion having a sharpened inner edge and a relatively blunt outer end. The other side of the blade portion has a continuous cutting edge formed along substantially the full length thereof. In addition, the handle includes a generally T-shaped finger engaging member for securing the knife to the user's hand when the palm thereof is either closed about the handle, and the knife is used for cutting, or open and the hand is used for manipulation of the carcass or the like. The finger engaging member is disposed between first and second adjacent recesses formed along one side of the handle portion and which are adapted for respectively receiving the index and middle fingers. The two recesses are each curved along an arc equal to about one-half of a circle, and they open in directions which are angled away from each other, whereby the fingers may be received therein and laterally spread apart.

Preferably, the body of the knife is formed of an integral metallic material, and the blade portion and handle portion are of substantially equal lengths. The hook-shaped portion is located medially along the length of one side of the blade portion, and is reversely curved toward said handle portion. The portion of the side which extends beyond the hook-shaped portion has a relatively straight, sharp edge which is adapted for chopping various parts of the animal carcass.

Some of the objects having been stated, other objects will appear as the description proceeds, when taken in connection with the accompanying drawings in which FIG. 1 is a side elevation view illustrating on face of a hunting knife embodying the features of the present invention;

FIG. 2 is a similar view of the opposite face of the knife shown in FIG. 1;

FIGS. 3, 4, 5, and 6 are sectional views taken respectively along the lines 3—3, 4—4, 5—5 and 6—6 of FIG. 1;

Figures 1, 2, 3, 4, 5, 6, 7, 8, 9, 10, 11:
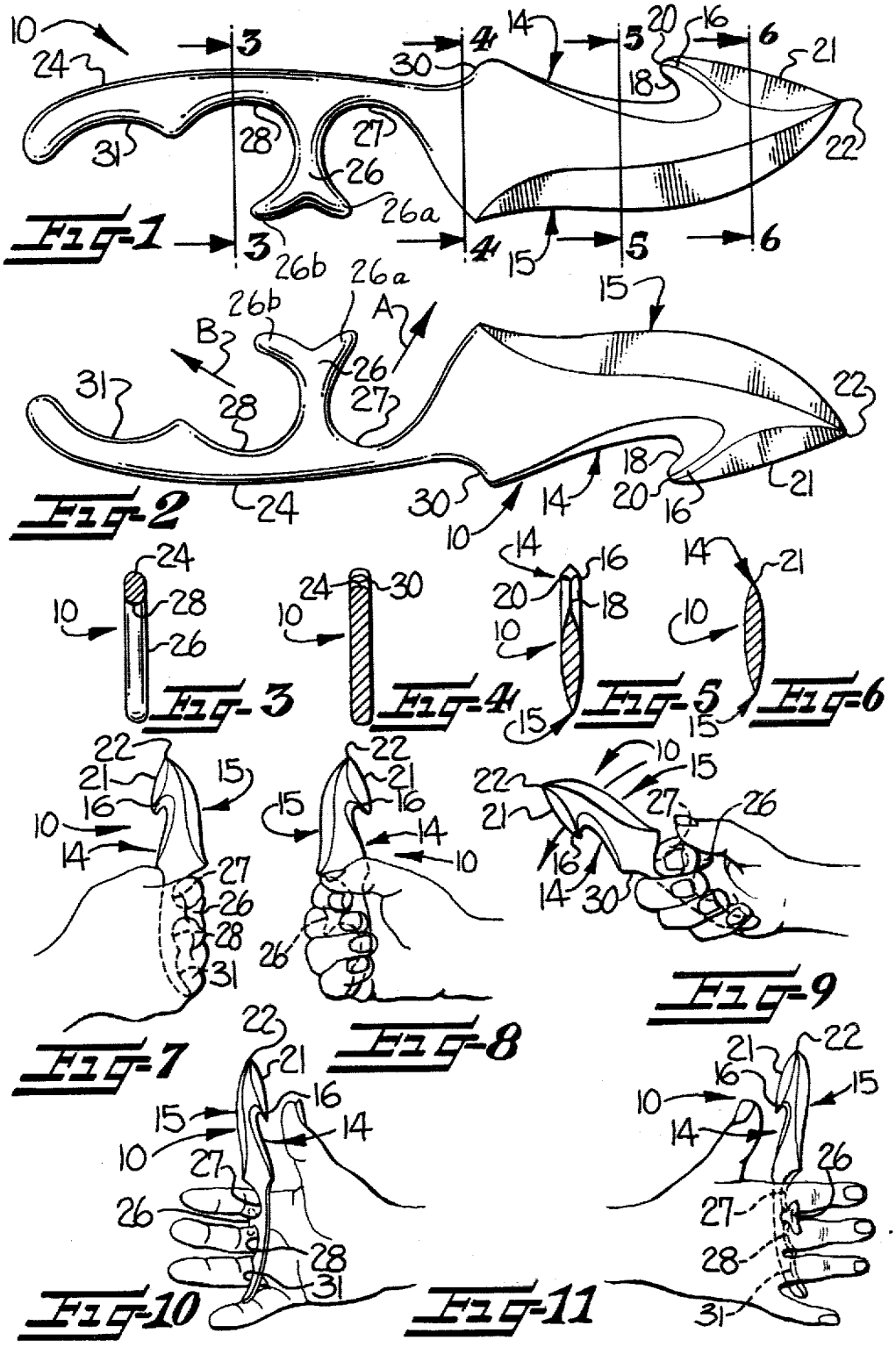
FIGS. 7 and 8 illustrate opposite faces of the knife, while being held in the user's hand and in position for eviscerating or skinning an animal.
FIG. 9 illustrates the manner in which the knife may be held while drawing the hook-shaped edge through the hide, or to effect chopping.
FIG. 10 illustrates the manner in which the knife is retained on the user's hand when the palm thereof is open and the fingers laterally spread apart.
FIG. 11 is a view similar to FIG. 10 but showing the back side of the hand.

Referring more specifically to the drawings, there is illustrated a knife 10 which embodies the features of the present invention. The knife 10 comprises a relatively thin integral body, fabricated from a suitable metallic material such as stainless steel, and which comprises a blade portion which is positioned to the right of line 4—4 in FIG. 1, and a handle portion which is positioned to the left of line 4—4. As will be observed, the blade portion and handle portion are of substantially equal lengths.

The blade portion includes opposite sides 14 and 15, which define a widthwise direction extending therebetween. The side 14 has a hook shaped portion 16 formed therein and which is reversely curved toward the handle portion. Further, the hook shaped portion has a sharpened arcuate inner edge 18 and a relatively blunt outer end 20, both of which face rearwardly toward the handle portion. The other side 15 of the blade portion has a continuous sharp cutting edge formed along substantially the full length thereof.

The hook-shaped portion 16 is located medially along the length of the side 14, and the portion 21 of the side 14 which extends beyond the hook-shaped portion 16 joins the other side 15 of the blade portion in a sharp point at 22. The portion 21 of the side 14 has a relatively straight, sharp edge along its length which is adapted for chopping various parts of the animal carcass in the manner further described below.

The handle portion defines a rear side 24 which faces in the same direction as, and is generally aligned with the side 14 of the blade portion, and an opposite or front side (not numbered) which faces in the same direction as the side 15 of the blade portion. The handle portion further includes finger engaging means for securing the knife to the user's hand when the palm thereof is closed about the handle portion (note FIGS. 7 and 8) as well as when the palm of the hand is open (note FIGS. 10 and 11). This finger engaging means comprises a generally T-shaped member 26 which extends in the widthwise direction from the front side of the handle portion, and with the T-shaped member being located between adjacent recesses 27 and 28. As will be apparent, these two recesses are open sided and adapted to respectively receive the index and middle fingers of the user's hand, and the fingers may be laterally moved into the recesses through the open sides thereof.

The first recess 27 is disposed adjacent the blade portion and has an arcuate inner edge which is smoothly curved along an arc equal to about one-half of a circle and which faces in a direction A (FIG. 2) which is inclined from the widthwise direction toward the blade portion at an angle of about 40 degrees in the illustrated embodiment. The second recess 28 has an arcuate inner edge which is smoothly curved along an arc equal to about one-half of a circle and faces in a direction B which is inclined from the widthwise direction in a direction away from the blade portion at an angle of about 50 degrees. Thus the directions A and B are disposed generally oppositely and outwardly, and as specifically illustrated, at an angle of about 90 degrees with respect to each other, and the opposite sides of the T-shaped member 26 are respectively defined by portions of the inner edges of the two recesses 27 and 28. Stated in other words, each respective recess 27, 28 defines a respective upper overhanging portion 26*a*, 26*b* with said upper overhanging portions being generally opositely directed so as to overlie the corresponding finger received therein. This configuration results in the T-shaped member 26 being able to secure the knife to the user's hand when the palm is either open or closed, and the orientation of the recesses 27 and 28 permits the fingers to be spread apart when the hand is open as seen in FIGS. 10 and 11, without release of the knife. Further, the orientation of the recesses permits the knife to be easily and readily released and replaced, if such becomes necessary, using only the hand which is to hold the knife. Thus the other hand is not needed for such release and replacement, and is free for other uses.

It will also be noted from the drawings that the average width of the handle portion is substantially less than the average width of the blade portion, and that the outer extremity of the T-shaped member 26 is generally aligned in the longitudinal direction with the side 15 of the blade portion. The joinder of the rear side 24 of the handle portion with the side 14 of the blade portion includes an arcuate protuberance 30 which is adapted to support the thumb directly thereon, and as an alternative to placing the thumb along the side face of the knife as seen in FIG. 8. Further, the handle portion includes a third arcuate finger receiving open sided recess 31 adjacent its remote or free end for receiving the third finger, and the rear side 24 of the handle portion is smoothly curved along its length so as to be adapted to comfortably rest against the palm of the hand. As will be seen, the handle portion has a length which generally conforms to the width of the user's hand.

In use, the knife 10 is gripped in the user's hand in the manner illustrated in FIGS. 7 and 8. The hide of the animal is initially punctured in the crotch area utilizing the point 22, and the hook-shaped portion 16 is then inserted into the opening, and the knife is drawn along the hide such that the edge 18 of the hook-shaped portion effects cutting. The blunt end 20 of the hook-shaped portion serves to avoid puncturing the internal entrails as the knife moves through the hide. Should any cartilage or light bone be encountered which cannot be readily severed, the knife may be withdrawn and used in a chopping manner by striking the cartilage or other obstruction with the edge surface 21, in the manner illustrated in FIG. 9, to effectively cut therethrough.

It will be noted that the T-shaped member 26 serves to prevent the user's hand from slipping along the handle portion as the knife is drawn through the hide. Also, should it be necessary to physically move the carcass during the cutting operation, it will be apparent that the hand holding the knife may be opened to assist in such movement, and the knife will be secured to the open hand by the member 26 in the manner illustrated in FIGS. 10 and 11. Thus the knife need not be placed upon the ground during such non-cutting manual operations.

When the eviscerating procedure is completed, the knife may be similarly held to effect skinning of the animal. Here again, the member 26 serves to prevent the hand from slipping along the handle portion during cutting, while also serving to retain the knife on the hand when the hand is opened and the fingers spread apart to grasp the hide.

In the drawings and specification, there has been set forth a preferred embodiment of the invention, and although specific terms are employed, they are used in a generic and descriptive sense only and not for purposes of limitation. Also, while the illustrated knife is particularly adapted for eviscerating and skinning animals as described, it is not limited to such use and it may be used for any similar cutting operation.

That which is claimed is:

1. A knife particularly adapted for use by hunters in eviscerating and skinning animals in the field, and comprising an elongate integral metallic body defining a blade portion and a handle portion of substantially equal lengths, said blade portion including opposite sides, with one side having a hook-shaped portion formed therein, said hook-shaped portion being reversely curved toward said handle portion and having a sharpened arcuate inner edge and a relatively blunt outer end, and with the other side of said blade portion having a continuous cutting edge formed along substantially the full length thereof, and said handle portion including finger engaging means for securing the knife to the user's hand when the palm thereof is closed about the handle portion and the knife is used for cutting, as well as when the palm is open and the hand is used for manipulation of the animal carcass or the like, said finger engaging means being defined at least partially by a pair of open sided adjacent arcuate recesses having generally oppositely and outwardly directed openings, each respective recess defining an upper overhanging portion with said upper overhanging portions being generally oppositely and outwardly directed so as to overlie the corresponding finger received therein.

2. The knife as defined in claim 1 wherein said hook shaped portion is located medially along the length of said one side of said blade portion, and wherein the portion of said one side which extends beyond the hook shaped portion joins said other side of said blade portion in a sharp point.

3. The knife as defined in claim 2 wherein the portion of said one side which extends beyond the hook shaped portion and to said point has a relatively straight, sharp edge which is adapted for chopping various parts of an animal carcass or the like.

4. The knife as defined in any one of claims 1, 2, or 3 wherein said handle portion comprises a relatively smooth rear side which faces in the same direction as and is generally aligned with said one side of said blade portion, and a front side which faces in the same direction as said other side of said blade portion, said front side including at least three open sided arcuate recesses which are adapted to respectively receive an individual finger therein, and whereby in use the rear side of said handle portion rests against the palm of the user's hand and the fingers are disposed within the recesses on said front side.

5. The knife as defined in claim 4 wherein said opposite sides of said blade portion define a widthwise direction extending therebetween, and wherein said finger engaging means includes a generally T-shaped member extending in the widthwise direction from said front side of said handle portion, and with said T-shaped member being located between and being partially defined by two of said recesses.

6. The knife as defined in claim 5 wherein the average width of said handle portion is substantially less than the average width of said blade portion, and wherein the outer extremity of said T-shaped member is generally aligned with said other side of said blade portion.

7. The knife as defined in claim 6 wherein the joinder of said rear side of said handle portion and said one side of said blade portion includes an arcuate protuberance which is adapted to support the user's thumb directly thereon.

8. A knife particularly adapted for use by hunters in eviscerating and skinning animals in the field, and comprising an elongate body defining a blade portion and a handle portion, said blade portion being formed of a metallic material and including opposite sides which define a widthwise direction extending therebetween, and with one side having a hook shaped portion formed therein, said hook shaped portion having a sharpened inner edge facing toward said handle portion and a relatively blunt outer end, and with the other side of said blade portion having a continuous cutting edge formed along substantially the full length thereof, and said handle portion having a generally T-shaped finger engaging member extending in a widthwise direction from one side thereof, said T-shaped member being disposed between first and second adjacent open sided recesses formed along said one side of said handle portion and which are adapted for respectively receiving laterally therein the index and middle fingers of the user's hand, with said first recess being disposed adjacent said blade portion and having an arcuate inner edge which faces in a direction which is inclined from the widthwise direction toward said blade portion, and with said second recess having an arcuate inner edge which faces in a direction which is inclined from the widthwise direction in a direction away from said blade portion, whereby the opposite sides of the T-shaped member are respectively defined by portions of the inner edges of said first and second recesses, and said T-shaped member acts to secure the knife to the user's hand when the palm thereof is closed about the handle portion and the knife is used for cutting, as well as when the palm is open and the hand is used for manipulation of the animal carcass, hide, or the like.

9. The knife as defined in claim 8 wherein the arcuate inner edge of each of said first and second recesses has an arcuate extent equal to about one-half of a circle.

10. The knife as defined in claim 9 wherein the direction in which the inner edge of said first recess faces is about 90 degrees from the direction in which the inner edge of said second recess faces.

11. The knife as defined in claim 8, 9 or 10 wherein said handle portion is formed integrally with said blade portion, and the blade portion and handle portion are of substantially equal lengths.

12. The knife as defined in claim 11 wherein said hook-shaped portion is located medially along the length of said one side of said blade portion, and wherein the portion of said one side which extends beyond the hook-shaped portion in a direction away from said handle portion has a relatively straight, sharp edge which is adapted for chopping various parts of an animal carcass or the like.

* * * * *